US011667996B2

(12) United States Patent
Rios et al.

(10) Patent No.: US 11,667,996 B2
(45) Date of Patent: Jun. 6, 2023

(54) ALUMINUM-FIBER COMPOSITES CONTAINING INTERMETALLIC PHASE AT THE MATRIX-FIBER INTERFACE

(71) Applicants: UT-Battelle, LLC, Oak Ridge, TN (US); Eck Industries, Inc., Manitowoc, WI (US)

(72) Inventors: Orlando Rios, Knoxville, TN (US); Michael S. Kesler, Knoxville, TN (US); Zachary C. Sims, Knoxville, TN (US); Edgar Lara-Curzio, Oak Ridge, TN (US); David Weiss, Manitowoc, WI (US)

(73) Assignees: UT-Battelle, LLC, Oak Ridge, TN (US); Eck Industries, Inc., Manitowoc, WI (US)

( * ) Notice: Subject to any disclaimer, the term of this patent is extended or adjusted under 35 U.S.C. 154(b) by 168 days.

(21) Appl. No.: 16/203,881

(22) Filed: Nov. 29, 2018

(65) Prior Publication Data

US 2019/0169725 A1 Jun. 6, 2019

Related U.S. Application Data

(60) Provisional application No. 62/594,792, filed on Dec. 5, 2017.

(51) Int. Cl.
*C22C 49/06* (2006.01)
*C22C 49/12* (2006.01)
(Continued)

(52) U.S. Cl.
CPC ..... *C22C 49/06* (2013.01); *C22C 47/04* (2013.01); *C22C 47/12* (2013.01); *C22C 49/12* (2013.01);
(Continued)

(58) Field of Classification Search
None
See application file for complete search history.

(56) References Cited

U.S. PATENT DOCUMENTS 3,535,093 A 10/1970 Sara
3,571,901 A * 3/1971 Sara ..... C22C 49/14 29/419.1
(Continued)

FOREIGN PATENT DOCUMENTS

CN 103343302 * 10/2013 ..... C22C 47/04
CN 106947949 * 7/2017

OTHER PUBLICATIONS

Fu et al., "A study on intermetallic compound formation in Ag—Al system and evaluation of its mechanical properties by micro-indentation", Mar. 1, 2018, J. Mat. Sci.-Mat. in Electronics, 29(5), pp. 3985-3991. (Year: 2018).*
(Continued)

*Primary Examiner* — Xiaobei Wang
(74) *Attorney, Agent, or Firm* — Scully, Scott, Murphy & Presser, P.C.

(57) ABSTRACT

A solid aluminum-fiber composite comprising: (i) an aluminum-containing matrix comprising elemental aluminum; (ii) coated or uncoated fibers embedded within said aluminum-containing matrix, wherein said fibers have a different composition than said aluminum-containing matrix and impart additional strength to said aluminum-containing matrix as compared to said aluminum-containing matrix in the absence of said fibers embedded therein; and (iii) an intermetallic layer present as an interface between each of said fibers and the aluminum-containing matrix, wherein said intermetallic layer has a composition different from said aluminum-containing matrix and said fibers, and said intermetallic layer contains at least one element that is also present in the aluminum-containing matrix and at least one
(Continued)

element present in the fibers, whether from the coated or interior portion of the fibers. Methods of producing the above-described composite are also described.

26 Claims, 11 Drawing Sheets

(51) Int. Cl.
*C22C 47/12* (2006.01)
*C22C 47/04* (2006.01)
*C22C 49/14* (2006.01)

(52) U.S. Cl.
CPC ..... *C22C 49/14* (2013.01); *Y10T 428/12736* (2015.01)

(56) References Cited

U.S. PATENT DOCUMENTS 3,871,834 A * 3/1975 Kuniya ..... C22C 49/14 148/437
4,402,744 A 9/1983 Sara
4,731,298 A * 3/1988 Shindo ..... C22C 49/14 428/611
4,853,294 A 8/1989 Everett et al.
4,889,774 A * 12/1989 Fukizawa ..... B22F 3/26 428/614
5,385,195 A * 1/1995 Bell ..... C22C 49/14 164/66.1
5,523,171 A * 6/1996 Yoon ..... B22D 19/14 428/608
5,814,408 A * 9/1998 Ting ..... B22D 19/14 257/E23.112
6,329,056 B1 12/2001 Deve et al.
6,485,796 B1 11/2002 Carpenter et al.

OTHER PUBLICATIONS

Barnhurst et al., "Zinc and Zinc Alloys", 1990, ASM Int'l, ASM Handbook vol. 2, pp. 527-534. (Year: 1990).*
Marochnik, "Characteristics for grade AK12", <http://www.splav-kharkov.com/en/e_mat_start.php?name_id=1375>, accessed Dec. 17, 2020.*
Okamoto, H., Al—Ce, May 28, 2011, J. of Phase Equilibria and Diffusion, vol. 32 No. 4, pp. 392-393. (Year: 2011).*
Alcotec, "How and why alloying elements are added to aluminum", Jan. 1, 2017, <https://web.archive.org/web/20170101031104/http://www.alcotec.com:80/us/en/education/knowledge/qa/How-and-why-alloying-elements-are-added-to-aluminum>, archived by Wayback Machine and accessed Oct. 27, 2021. (Year: 2017).*
Li S-H. et al., "Effects of Carbon Fiber/AI Interface on Mechanical Properties of Carbon-Fiber-Reinforced Aluminum-Matrix Composites", Metallurgical and Materials Transactions A, (2004), vol. 35A, pp. 2153-2160.

* cited by examiner

3B

3A

ALUMINUM-FIBER COMPOSITES CONTAINING INTERMETALLIC PHASE AT THE MATRIX-FIBER INTERFACE

CROSS REFERENCE TO RELATED APPLICATION

The present application claims benefit of U.S. Provisional Application No. 62/594,792, filed on Dec. 5, 2017, all of the contents of which are incorporated herein by reference.

STATEMENT REGARDING FEDERALLY SPONSORED RESEARCH

This invention was made with government support under Prime Contract No. DE-AC05-00OR22725 awarded by the U.S. Department of Energy. The government has certain rights in the invention.

FIELD OF THE INVENTION

This invention generally relates to the field of aluminum metal matrix composites, and more specifically, high pressure die casting of aluminum metal matrix composites.

BACKGROUND OF THE INVENTION

While aluminum and many of its alloys are used as structural materials in such industries as aerospace and automotive, there is a demand for higher strength and lower density versions of aluminum materials. Aluminum matrix composites, which include aluminum reinforced with high strength fibers, have been investigated. However, the aluminum matrix composites of the conventional art possess inadequate strength and too high a density for several applications, particularly those that subject a part to very high mechanical loads, often along with turbulent and oscillatory movements. Under such extreme conditions, currently available aluminum materials are highly prone to failure. Thus, there would be a significant benefit in new aluminum-based materials that are more resilient than the options currently available, and hence, more suitable for use in such critical applications.

SUMMARY OF THE INVENTION

In one aspect, the present disclosure is directed to solid aluminum-fiber composite materials that contain an aluminum-containing matrix and high-strength coated or uncoated fibers embedded within the aluminum-containing matrix. The aluminum-fiber composite possesses a very high strength, which may be higher than many of the aluminum matrix composites of the art, by virtue of a unique intermetallic layer present at interfaces between the fibers and aluminum-containing matrix. The intermetallic layer is specially designed to promote adhesion between the fibers and matrix. More specifically, the aluminum-fiber composite has the following components: (i) an aluminum-containing matrix containing elemental aluminum; (ii) fibers embedded within the aluminum-containing matrix, wherein the fibers have a different composition than the aluminum-containing matrix and impart additional strength to the aluminum-containing matrix as compared to the aluminum-containing matrix in the absence of the fibers embedded therein; and (iii) an intermetallic layer present as an interface between each of the fibers and the aluminum-containing matrix, wherein the intermetallic layer has a composition different from the aluminum-containing matrix and the fibers, and the intermetallic layer contains at least one element that is also present in the aluminum-containing matrix and at least one element from said fibers. The at least one element from the fibers may be at least one element from the coating on the fibers and/or at least one element from the internal (or uncoated portion) of the fibers.

In another aspect, the present disclosure is directed to a first method of producing the aluminum-fiber composite described above. In the first method, the intermetallic layer is formed by mixing coated fibers with a molten aluminum-containing matrix and allowing the resulting mixture to cool to form the composite. The intermetallic layer has a composition that includes the composition of the coating and at least one element present in the aluminum-containing matrix. One or more elements from the fiber uncoated or interior portion) may or may not also be included in the intermetallic layer. More specifically, the first method includes the following steps: (i) mixing coated fibers with a molten aluminum-containing matrix containing elemental aluminum to produce a molten aluminum-fiber composite, wherein each of the coated fibers contains a fiber and a coating on surfaces of the fiber, wherein the coated fibers (i.e., both coating and interior portions) have a different composition than the aluminum-containing matrix and impart additional strength to the aluminum-containing matrix as compared to the aluminum-containing matrix in the absence of the coated fibers embedded therein, wherein the coating has a composition different from the aluminum-containing matrix and the uncoated portion of the coated fibers and contains at least one element other than aluminum and which alloys with at least aluminum; and (ii) cooling the molten mixture to produce the solid aluminum-fiber composite, wherein the solid aluminum-fiber composite contains the coated fibers embedded within the aluminum-containing matrix, wherein an intermetallic layer is present as an interface between each of the fibers and the aluminum-containing matrix, and the intermetallic layer has a composition that includes the composition of the coating and at least one element that is also present in the aluminum-containing matrix. In some embodiments, after the cooling step (ii), the solid aluminum-fiber composite is heated to a temperature up to but not exceeding (or below) the melting point of the solid aluminum-fiber composite to induce or promote precipitation of at least one element from the aluminum-containing matrix into the intermetallic layer, which may have formed upon cooling from the molten aluminum-containing matrix and/or after the heating step in the solid composite.

In another aspect, the present disclosure is directed to a second method of producing the aluminum-fiber described above. In the second method, the intermetallic layer is formed by mixing uncoated fibers with a molten aluminum-containing matrix that contains aluminum and at least one alloying element, and allowing the resulting mixture to cool to form the solid composite. More specifically, the second method includes the following steps: (i) mixing uncoated fibers with a molten aluminum-containing matrix containing elemental aluminum to produce a molten aluminum-fiber composite, wherein the aluminum-containing matrix is an alloy containing aluminum and at least one alloying element other than aluminum, wherein the uncoated fibers have a different composition than the aluminum-containing matrix and impart additional strength to the aluminum-containing matrix as compared to the aluminum-containing matrix in the absence of the fibers embedded therein; and (ii) cooling the molten mixture to produce the solid aluminum-fiber composite, wherein the solid aluminum-fiber composite contains the fibers embedded within the aluminum-containing matrix, wherein an intermetallic layer is present as an interface between each of the uncoated fibers and the aluminum-containing matrix, and the intermetallic layer has a composition different from the aluminum-containing matrix and the uncoated fibers and includes at least the alloying element from the matrix and at least one element from the uncoated fibers. In some embodiments, after the cooling step (ii), the solid aluminum-fiber composite is heated to a temperature up to but not exceeding (or below) the melting point of the solid aluminum-fiber composite to induce or promote precipitation of at least one element from the aluminum-containing matrix into the intermetallic layer, which may have formed upon cooling from the molten aluminum-containing matrix and/or after the heating step in the solid composite.

BRIEF DESCRIPTION OF THE FIGURES

FIG. 1A is a schematic of a squeeze casting process for in situ precipitation of an intermetallic phase onto a woven fiber structure to produce a fiber-matrix intermetallic interface of high strength. The process involves melting of the aluminum alloy, squeeze casting of the aluminum alloy into a woven fiber structure, and heat treatment to induce precipitation of at least one alloying element from the aluminum-containing matrix on the fibers. FIG. 1B is a general schematic showing the formation of anchoring interfacial precipitates in an Al—Ce—Cu, Al—Ce—Fe, or Al—Ce—Cu—Fe matrix having carbon fiber incorporated therein.

FIGS. 2A and 2B show low and high scanning electron microscope (SEM) magnifications, respectively, of an aluminum carbon fiber composite, with fibers aligned in the longitudinal direction. FIGS. 2C and 2D show low and high SEM magnifications, respectively, of the aluminum carbon fiber composite, with fibers aligned in the transverse direction. Both orientations exhibit good coating of fibers with a precipitate phase. The inset in FIG. 2A shows the presence of intermetallic phases at the fiber matrix interface.

FIG. 3A is a chart comparing the ultimate tensile strength of epoxy composites with an aluminum-carbon fiber composite described herein, and FIG. 3B is a chart comparing the Young's modulus of epoxy composites with the same aluminum-carbon fiber composite described herein.

DETAILED DESCRIPTION OF THE INVENTION

Figure 1A:
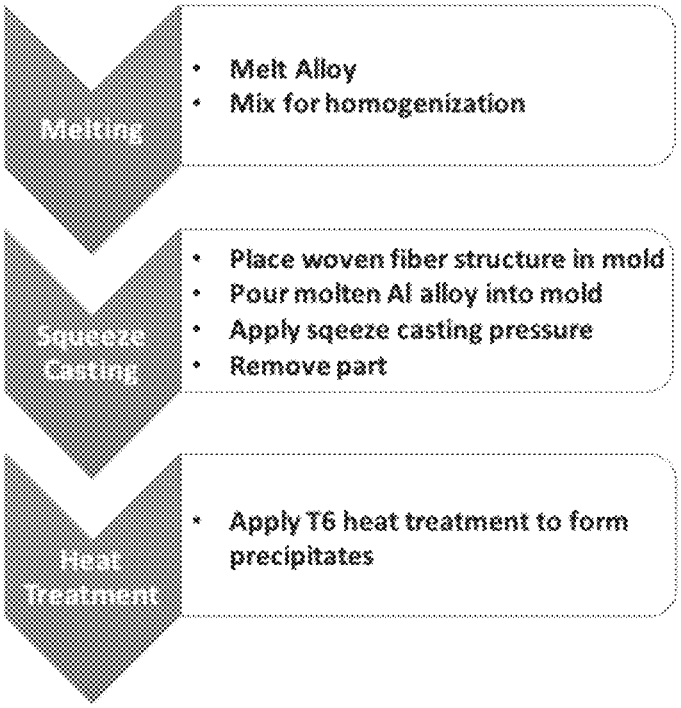
FIGS. 1A, 1B.

In one aspect, the invention is directed to aluminum-fiber composite materials in which high-strength fibers are embedded in an aluminum-containing matrix (i.e., "matrix") containing elemental aluminum, i.e., aluminum in the zerovalent state, which cannot be an oxide form or other ionic form of aluminum. In the composite, an intermetallic layer is present as an interface between each of the fibers and the aluminum-containing matrix, wherein the intermetallic layer has a composition different from the aluminum-containing matrix and the fibers. The intermetallic layer contains at least one element that is also present in the aluminum-containing matrix.

The term "aluminum-containing matrix" refers to a solid (or liquid when in the heated molten state) volume of aluminum-containing composition in which fibers are embedded. For purposes of the present invention, the aluminum-containing matrix generally contains at least 10 wt % elemental aluminum (Al). In different embodiments, the amount of aluminum in the aluminum-containing matrix may be precisely, at least, or above, for example, 10, 20, 30, 40, 50, 60, 70, 80, 90, 95, 98, 99, or 100 wt %, or the amount of aluminum is within a range bounded by any two of the foregoing values. In some embodiments, the aluminum-containing matrix contains only aluminum, which may refer to 100% pure aluminum or aluminum with only trace amounts of other metals, such as greater than 99 wt % aluminum with less than 1 wt %, 0.5 wt %, 0.2 wt %, or 0.1 wt % of trace elements. In other embodiments, the aluminum-containing matrix is an aluminum alloy. The aluminum alloy contains aluminum and at least one, two, or three other elements alloyed with the aluminum. The one or more alloying elements are generally included in the aluminum-containing matrix in a total amount of at least 1 or 2 wt %. In different embodiments, the one or more alloying elements are included in the aluminum-containing matrix in a total amount of precisely, at least, or no more than 2, 5, 10, 15, 20, 30, 40, 50, or 60 wt % or within a range bounded by any two of the foregoing values. The alloying elements may be in an elemental or oxidized state. If in an oxidized state, the alloying element is typically reduced to its elemental state in the aluminum melt.

In the case of the aluminum-containing matrix being an aluminum alloy, the one or more alloying elements are any such elements that are completely soluble in aluminum and also have good wetting ability in order to fully wet the surface of fibers embedded within the matrix. The one or more alloying elements can be selected from, for example, copper (Cu), iron (Fe), titanium (Ti), vanadium (V), chromium (Cr), manganese (Mn), cobalt (Co), nickel (Ni), zinc (Zn), scandium (scandium), yttrium (Y), cerium (Ce), lanthanum (La), thorium (Th), magnesium (Mg), calcium (Ca), silicon (Si), zirconium (Zr), lithium (Li), and boron (B). In some embodiments, the alloy is a binary alloy, such as an Al—Cu, Al—Fe, Al—Ti, Al—V, Al—Cr, Al—Mn, Al—Co, Al—Ni, Al—Zn, Al—Ce, Al—La, Al—Mg, Al—Si, Al—Zr, Al—Li, or Al—B alloy. In other embodiments, the alloy is a ternary alloy, such as an Al—La—Cu, Al—La—Fe, Al—La—Ti, Al—La—V, Al—La—Cr, Al—La—Mn, Al—La—Co, Al—La—Ni, Al—La—Zn, Al—La—Ce, Al—La—Mg, Al—La—Si, Al—La—Zr, Al—La—Li, Al—La—B, Al—Ce—Cu, Al—Ce—Fe, Al—Ce—Ti, Al—Ce—V, Al—Ce—Cr, Al—Ce—Mn, Al—Ce—Co, Al—Ce—Ni, Al—Ce—Zn, Al—Ce—Mg Al—Ce—Zr Al—Cu—Fe, Al—Cu—Ti, Al—Cu—V, Al—Cu—Cr, Al—Cu—Mn, Al—Cu—Co, Al—Cu—Ni, Al—Cu—Zn, Al—Cu—Mg, Al—Cu—Si, Al—Cu—Zr, Al—Cu—Li, Al—Cu—B, Al—Ni—Cr, Al—Ni—Mn, Al—Ni—Co, Al—Ni—Zn, Al—Ni—Mg, Al—Ni—Si, Al—Ni—Zr, Al—Ni—Li, Al—Ni—B, Al—Ti—V, Al—Ti—Cr, Al—Ti—Mn, Al—Ti—Co, Al—Ti—Zn, Al—Ti—Mg, Al—Ti—Si, Al—Ti—Zr, Al—Ti—Li, or Al—Ti—B. In other embodiments, the alloy is a quaternary alloy, such as an Al—La—Ce—Cu, Al—La—Ce—Ti, Al—La—Ce—V, Al—La—Ce—Cr, Al—La—Ce—Mn, Al—La—Ce—Co, Al—La—Ce—Ni, Al—La—Ce—Zn, Al—La—Ce—Mg, Al—La—Ce—Si, Al—La—Ce—Zr, Al—La—Ce—Li, Al—La—Ce—B, Al—Cu—Ce—Fe, Al—Cu—Ce—Ti, Al—Cu—Ce—V, Al—Cu—Ce—Cr, Al—Cu—Ce—Mn, Al—Cu—Ce—Co, Al—Cu—Ce—Ni, Al—Cu—Ce—Zn, Al—Cu—Ce—Mg, Al—Cu—Ce—Si, Al—Cu—Ce—Zr, Al—Cu—Ce—Li, Al—Cu—Ce—B, Al—Ni—Ce—Fe, Al—Ni—Ce—La, Al—Ni—Ce—Si Al—Ni—Ce—Ti, Al—Ni—Ce—Mg, Al—Cu—La—Fe, Al—Cu—La—Ti, Al—Cu—La—V, Al—Cu—La—Cr, Al—Cu—La—Mn, Al—Cu—La—Co, Al—Cu—La—Ni, Al—Cu—La—Zn, Al—Cu—La—Mg, Al—Cu—La—Si, Al—Cu—La—Zr, Al—Cu—La—Li, Al—Cu—La—B, Al—Ni—La—Fe, Al—Ni—La—Ti, Al—Ni—La—V, Al—Ni—La—Cr, Al—Ni—La—Mn, Al—Ni—La—Co, Al—Ni—La—Ni, Al—Ni—La—Zn, Al—Ni—La—Mg, Al—Ni—La—Li, Al—Ni—La—B, Al—Cu—Ni—Fe, Al—Cu—Ni—Mg, Al—Cu—Ni—Ti, Al—Fe—Ni—Mg, or Al—Fe—Ni—Ti alloy. The aluminum alloy may also correspond to any of the known aluminum cast or wrought alloys. Some examples of aluminum cast alloys include the Al-100 (A1-1xx.x), Al-200, Al-300, Al-400, Al-500, Al-700, Al-800, and Al-900 series. Some examples of aluminum wrought alloys include the Al-1000, Al-2000, Al-3000, Al-4000, A1-5000, A1-6000, or A1-7000 series. An example of such an alloy is Al-2024, which contains 4.4 wt % Cu, 0.6 wt % Mn, and 1.5 wt % Mg.

The term "fiber" refers to an elongated shape having a length dimension at least three times the remaining width dimensions, wherein the remaining width dimensions may be the same or different. By having a length dimension at least three times the remaining width dimensions, the fiber has an aspect ratio of at least 3:1. In different embodiments, the aspect ratios of the fibers are precisely, at least, or greater than, for example, 3:1, 4:1, 5:1, 10:1, 20:1, 50:1, 100:1, 200:1, 300:1, 400:1, 500:1, or 1000:1, or within a range bounded by any two of the foregoing ratios. The fiber may have a width of, for example, 1 nm, 2 nm, 5 nm, 10 nm, 20 nm, 50 nm, 100 nm, 200 nm, 500 nm, 1 μm, 2 μm, 5 μm, 10 μm, 20 μm, 50 μm, 100 μm, 200 μm, 500 μm, 1 mm, or 2 mm, or a width within a range bounded by any two of the foregoing values. The possible lengths of the fibers can be deduced from the above widths in conjunction with the possible aspect ratios provided above.

The above aspect ratios are generally in reference to discrete fibers wherein the fibers in the matrix are separated from each other by areas of aluminum-containing matrix. The discrete fibers may or may not alternatively be in the form of discrete interconnected assemblies (i.e., assemblages) of fibers, with each discrete fiber assemblage surrounded by an area of aluminum-containing matrix. The discrete fiber assemblages may be, for example, discrete units of bundled, woven, or non-woven fibers. The interconnected assembly may include spacings between the fibers, particularly in the case of woven or non-woven fibers. In other embodiments, the term "fiber" refers to a continuous fiber or fiber assemblage. A continuous fiber refers to a fiber having a length dimension of at least 1, 2, 3, 4, or 5 cm, with typical widths in the micron scale. In some embodiments, the term "continuous fiber" also refers to a tow (i.e., bundle) of hundreds or thousands of fibers having a total bundle width in the micron scale, typically 10-1000 or 10-500 microns, or more typically, 3-10 microns. The term "continuous fiber" may alternatively refer to a woven or non-woven continuous assemblage of continuous fibers. Thus, a single continuous woven or non-woven assemblage of continuous fibers or tows thereof may be embedded within the aluminum-containing matrix. Alternatively, a multiplicity (two or more) of continuous woven or non-woven assemblage of continuous fibers or tows thereof may be embedded within the aluminum-containing matrix. Whether the fibers are discrete or continuous, the fibers are completely surrounded by the aluminum-containing matrix material with intervening intermetallic layer.

The fibers have a composition different from the composition of the aluminum-containing matrix. The one or more elements in the fibers may be in an elemental (zerovalent) or ionic state, except that the fibers do not include an element of Group 16 of the Periodic Table, i.e., the fibers are not composed of metal oxides, metal sulfides, and the like. Generally, the fiber composition includes an appreciable degree of covalent bonding, even if some ionic bonding is present. The composition of the fibers should be selected such that it imparts additional strength to the aluminum-containing matrix as compared to the aluminum-containing matrix in the absence of the fibers being incorporated therein. In a first set of embodiments, the fibers contain at least one transition metal in the zerovalent state. The term "transition metal" refers to the elements identified as Groups 3-12 of the Periodic Table. The transition metal may be a first row, second row, or third row transition metal. Some examples of transition metals include titanium, vanadium, chromium, manganese, iron, cobalt, nickel, copper, zinc, zirconium, niobium, molybdenum, palladium, tantalum, tungsten, platinum, and gold. In a second set of embodiments, the fibers contain at least one lanthanide element in the zerovalent state. The term "lanthanide" refers to any of the elements having atomic weights of 57-71, e.g., lanthanum (La), cerium (Ce), neodymium (Nd), or europium (Eu). In a third set of embodiments, the fibers contain at least one main group element in the zerovalent state. The term "main group element" refers to the elements identified as Groups 13 and 14 of the Periodic Table. Some examples of main group elements include carbon, silicon, germanium, tin, boron, and aluminum. In a fourth set of embodiments, the fibers contain at least one alkaline earth element in the zerovalent state. The term "alkaline earth element" refers to elements in Group 2 of the Periodic Table, e.g., magnesium, calcium, strontium, and barium.

In some embodiments, the fibers have a composition selected from any of the compositions provided above for the aluminum-containing matrix, except that the aluminum-containing matrix has a composition different than the fibers. To be different, the compositions of the matrix and fibers should differ in the presence or absence of at least one element. Thus, the fibers can include one or more elements selected from, for example, copper (Cu), iron (Fe), titanium (Ti), vanadium (V), chromium (Cr), manganese (Mn), cobalt (Co), nickel (Ni), zinc (Zn), cerium (Ce), lanthanum (La), magnesium (Mg), silicon (Si), zirconium (Zr), lithium (Li), and boron (B). The fibers may also have a composition corresponding to any of the classes or specific types of binary, ternary, or quaternary alloys provided above for the aluminum-containing matrix, provided the aluminum-containing matrix has a composition different than the fibers.

For example, if the matrix is composed of only aluminum, the fibers cannot be composed of only aluminum. In some embodiments, the fibers do not contain aluminum, i.e., aluminum is excluded from the fibers.

In some embodiments, the fibers are carbon-containing fibers in which the carbon may or may not be in elemental form. The carbon-containing fiber may be discrete fiber units, as described above, such as nanotubes or segments cut from a continuous carbon fiber. The carbon-containing fiber may alternatively be in continuous form, such as a tow, as described above. The discrete or continuous carbon fibers may also be in the form of assemblages of carbon fiber, such as woven or non-woven forms of carbon fiber, as also discussed above. In some embodiments, the carbon-containing fibers are composed of only carbon. In other embodiments, the carbon-containing fibers have a carbide composition, which contain carbon alloyed with at least one additional element. The carbide may also be considered to have an interstitial composition. Some examples of carbide compositions include silicon carbide (e.g., SiC), aluminum carbide (e.g., $Al_4C_3$), tungsten carbide (e.g., WC), iron carbide (e.g., $Fe_3C$), lanthanum carbide (e.g., $LaC_2$), cerium carbide (e.g., $CeC_2$), vanadium carbide (e.g., $V_4C_3$), niobium carbide (e.g., $Nb_4C_3$), tantalum carbide (e.g., $Ta_4C_3$), molybdenum carbide (e.g., $Mo_3C_2$), or magnesium carbide (MgC). The carbide composition may also be ternary, such as tungsten carbide cobalt (W—C—Co) or tungsten carbide copper (W—C—Cu). Additional ternary carbide compositions include Mn—Al—C, Ni—Al—C, Co—Al—C, and Co—Mg—C. The carbide composition may also have a ternary, quaternary, or higher order composition corresponding to any of the compositions provided above for the aluminum-containing matrix except that carbon is included. Some examples of such compositions include Al—Cu—C, Al—Ti—C, Al—V—C, Al—Cr—C, Al—Mn—C, Al—Co—C, Al—Ni—C, Al—Zn—C, Al—Ce—C, Al—La—C, Al—Mg—C, Al—Si—C, Al—Zr—C, Al—B—C, and Al—La—Ce—C. Moreover, the carbide composition may also correspond to any of the compositions provided above for the aluminum-containing matrix except that carbon has replaced aluminum. Some examples of such compositions include Ni—C, Mn—C, Ni—Ti—C, La—Ce—C, La—Fe—C, Cu—Ce—C, La—Cu—C, La—Ce—Cu—C, La—Ce—Fe, and La—Ce—Ti—C.

In other particular embodiments, the fibers have a nitride or boride composition. Some examples of nitride compositions include boron nitride (BN), aluminum nitride (AlN), gallium nitride (GaN), aluminum-gallium nitride, indium nitride, silicon nitride, lanthanum nitride, and titanium nitride. Some examples of boride compositions include aluminum boride, gallium boride, silicon boride, lanthanum boride, titanium boride, nickel boride, iron boride, nickel-iron boride, iron-lanthanum boride, and iron-neodymium boride. In some embodiments, the fibers have a lanthanum-containing composition or cerium-containing composition. In other embodiments, the fibers have a copper-containing composition or titanium-containing composition.

When embedded in the aluminum-containing matrix, each fiber is surrounded by an intermetallic layer that functions as an interface between each fiber and the aluminum-containing matrix. The intermetallic layer serves to strengthen the bond between the fibers and matrix, i.e., by further anchoring the fibers within the matrix. The term "intermetallic" is used herein to refer to an alloy composition containing at least one element that is also present in the aluminum-containing matrix. Although the term "intermetallic" may, in some contexts, be limited to include only metals, for purposes of the present invention, the term "intermetallic" refers to any alloy or interstitial composition formed from at least one element emanating from the aluminum-containing matrix and possibly at least one element emanating from the fiber, wherein one or more of the elements in the intermetallic layer may be non-metals, such as carbon. Generally, in addition to at least one element from the aluminum-containing matrix, the intermetallic layer includes at least one element originating from the fiber, whether the element originating from the fiber is from the interior of the fiber or from an outer layer or coating on the fiber. In some embodiments, the intermetallic layer contains at least one element that is also present in the aluminum-containing matrix and another element that is not present in the aluminum-containing matrix or in the fibers, e.g., Al—Mg matrix, Ce—Fe fibers, and Mg—Cu, Al—Cu, or Al—Mg—Cu intermetallic layer, wherein Cu is not in the matrix or fibers. In other embodiments, the intermetallic layer contains at least one element that is also present in the aluminum-containing matrix and another element that is also present in the fibers and another element that is not present in the aluminum-containing matrix or in the fibers, e.g., Al—Mg matrix, Ce—Fe fibers, and Mg—Cu—Ce, Mg—Cu—Fe, Mg—Cu—Ce—Fe, Al—Cu—Ce, Al—Mg—Cu—Ce, Al—Mg—Cu—Fe, or Al—Mg—Cu—Ce—Fe intermetallic layer, wherein Cu is not in the matrix or fibers. In some embodiments, such as any of the foregoing, the element not present in the matrix or fibers is a transition metal element. In some embodiments, the intermetallic layer includes one or more elements found only in the matrix and/or fibers. In other embodiments, the intermetallic includes all elements found in the matrix and fibers. In some embodiments, at least one or all of the elements in the intermetallic layer are in the zerovalent (elemental) state.

While the intermetallic layer contains at least one element that is also present in the aluminum-containing matrix, and generally at least one element provided from the fibers, the intermetallic layer has a composition different from both the aluminum-containing matrix and fibers. As an example, the aluminum-containing matrix may have a pure aluminum (Al) composition, the fibers may have a pure carbon (C) composition, and the intermetallic layer may have an aluminum-copper (Al—Cu) or aluminum-copper-carbon (Al—Cu—C) composition, wherein the Cu may have originated from a Cu coating on the carbon fibers, as further discussed below. As another example, the aluminum-containing matrix may have an Al—Cu composition, the fibers may have a carbon (C) composition, and the intermetallic layer may have a Cu—C, Al—C, or Al—Cu—C composition, wherein the Cu in the intermetallic layer may have originated from the matrix and/or from a Cu coating on the carbon fibers, as further discussed below. As another example, the aluminum-containing matrix may have an Al—Fe composition, the fibers may have a carbon (C) composition, and the intermetallic layer may have an Fe—C, Al—C, or Al—Fe—C composition. As another example, the aluminum-containing matrix may have an Al—Ce composition, the fibers may have a carbon (C) composition, and the intermetallic layer may have a Ce—C, Al—C, or Al—Ce—C composition. As another example, the aluminum-containing matrix may have an Al—Mg composition, the fibers may have a carbon (C) composition, and the intermetallic layer may have a Mg—C, Al—C, or Al—Mg—C composition. As another example, the aluminum-containing matrix may have a pure aluminum (Al) composition, the fibers may have a silicon carbide (SiC) composition, and the intermetallic layer may have an Al—Si, Al—C, or Al—Si—C composition, or, in the event the SiC fibers were coated with Cu, the intermetallic layer may have an Al—Cu, Al—Cu—C, Al—Cu—Si, or Al—Cu—Si—C composition. As yet another example, the aluminum-containing matrix may have an Al—Ce composition, the fibers may have a silicon carbide (SiC) composition, and the intermetallic layer may have a Al—Si, Al—C, Al—Si—C, Ce—Si, Ce—Si—C, or Al—Ce—Si—C composition, or, in the event the SiC fibers were coated with Cu, the intermetallic layer may have a Al—Cu, Al—Cu—C, Al—Cu—Si—C, Ce—Cu, Ce—Cu—C, Ce—Cu—Si, Ce—Cu—Si—C, or Al—Ce—Cu—Si—C composition.

In another aspect, the invention is directed to a first method of producing the aluminum-fiber composites described above. In the method, coated fibers are mixed with the aluminum-containing matrix, which may be any of the aluminum or aluminum alloy compositions described above, and which has been rendered molten (i.e., heated until melted) to permit mixing. The mixture of molten matrix with fibers is also herein referred to as the "molten material". The mixing step can be referred to as the first step or step (i). The fibers can have any of the compositions described above, with the composition of the fibers being different than the composition of the aluminum-containing matrix, as described above. The coating on the surfaces of the fibers is different from the aluminum-containing matrix and non-coated portion of the fibers. In some embodiments, the coating on the fibers has a composition that does not include an element in common with the aluminum-containing matrix. The coating on the fibers is selected such that at least one element (or all elements) in the coating becomes incorporated into the intermetallic layer. The coating contains at least one element other than aluminum and which alloys with at least aluminum. The mixing can be performed by any of the means well known in the art for such purpose, such as by manual or mechanical mixing. In some embodiments, the fibers are within a bundle or interconnected assembly (i.e., woven or non-woven assemblage) having spacings between the fibers, and the molten aluminum-containing matrix is infiltrated into the spacings by pressing the aluminum-containing matrix into the spacings. Thus, the term "mixing," as used herein, also includes processes in which the molten matrix is pressed into spacings of a bundle or interconnected assembly of fibers. The molten matrix is pressed into the spacings between the fibers by applying a sufficient amount of pressure on the molten matrix. The pressure applied onto the matrix may be, for example, a pressure of at least or above 50, 100, or 200 bar and up to or below 500, 800, 1000, or 1200 bar, or alternatively, a pressure within a range bounded by any two of the foregoing values. In some embodiments, the pressure is applied onto the matrix in a die cast or squeeze cast machine. The method may also include coating the fibers, prior to the mixing step, by methods well known in the art. As the mixing step is performed on the material with the aluminum-containing matrix in the molten state, the temperature of the molten material necessarily needs to be maintained at or above the melting point of the molten material during the mixing step. Typically, for purposes of the invention, the molten material is maintained at a temperature at or above the melting point of the molten material, and up to or below a temperature of 50, 100, 150, or 200° C. above the melting point of the molten material.

Following the mixing step, the mixture of molten aluminum-containing matrix and coated fibers is cooled to produce the solid aluminum-fiber composite. The aluminum-fiber composite may have any of the compositions and structures described in detail earlier above. The cooling step can be referred to as the second step or step (ii). The intermetallic layer generally includes the composition of the coating on the fiber (i.e., all elements found in the coating) along with at least one element (e.g., Al) that is also present in the aluminum-containing matrix. The intermetallic layer may or may not also include at least one element present in the uncoated portion of the fiber. That is, in some embodiments, the intermetallic layer has a composition that includes the composition of the coating, at least one element that is present in the aluminum-containing matrix, and at least one element that is present in the fibers (i.e., in the part of the fibers excluding the coating). As an example, the aluminum-containing matrix may have an Al—Ce composition, the fibers may have a copper-coated carbon (Cu-coated C) composition, and the intermetallic layer may have, for example, a Cu—Al, Cu—Ce, Cu—Al—Ce, Cu—Al—C, Cu—Ce—C, or Cu—Al—Ce—C composition. If the foregoing matrix further includes Fe, the intermetallic layer may have, for example, a Cu—Fe—Al, Cu—Ce—Fe, Cu—Al—Ce—Fe, Cu—Fe—Al—C, Cu—Fe—Ce—C, or Cu—Fe—Al—Ce—C composition. In the foregoing example with Al—Ce as matrix, if the fiber has a binary composition, such as SiC, the intermetallic may have, for example, a Cu—Al, Cu—Ce, Cu—Al—C, Cu—Ce—C, Cu—Al—Ce—C, Cu—Al—Si, Cu—Ce—Si, Cu—Al—Ce—Si, or Cu—Al—Ce—Si—C composition. In some embodiments, the intermetallic layer contains all elements in the coating and also contains all elements of the matrix. In some embodiments, the intermetallic layer has a composition that includes the composition of the coating (i.e., all elements in the coating), all elements that are present in the aluminum-containing matrix, and at least one element that is present in the fibers (i.e., in the part of the fibers excluding the coating). Depending on the composition of the coating used, the intermetallic layer produced by the first method described above may have any of the exemplary intermetallic compositions described earlier above. The coating on the fibers may be composed of a single element or may be an alloy of two or more elements, such as Cu—Fe, Cu—Si, Cu—Mg, Fe—Si, Fe—Si—C, or any of the alloys described above for the aluminum-containing matrix.

In another aspect, the invention is directed to a second method of producing the aluminum-fiber composites described above. In the method, uncoated fibers are mixed with an aluminum alloy matrix, having any of the alloy compositions described above in which aluminum is alloyed with at least one alloying element, and which has been rendered molten (i.e., heated until melted) to permit mixing. The mixing step can be referred to as the first step or step (i). The fibers can have any of the compositions described above, with the composition of the fibers being different than the composition of the aluminum-containing matrix, as described above. The mixing can be performed by any of the means well known in the art for such purpose, such as by manual or mechanical mixing, or by application of pressure, as discussed above. That is, in some embodiments, the fibers are within a bundle or interconnected assembly (i.e., woven or non-woven assemblage) having spacings between the fibers, and the molten aluminum-containing matrix is infiltrated into the spacings by pressing the aluminum-containing matrix into the spacings, as described above. The molten matrix is pressed into the spacings between the fibers by applying a sufficient amount of pressure on the molten matrix, as described above.

Following the mixing step above, the mixture of molten aluminum-containing matrix and fibers is cooled to produce the solid aluminum-fiber composite, as described above for the first method. The resulting solid aluminum-fiber composite may have any of the compositions and structures described in detail above. The cooling step can be referred to as the second step or step (ii). The intermetallic layer in the final cooled composite may correspond to any of the intermetallic compositions described above, as formed by precipitation of at least one alloying element from the aluminum-containing matrix during the mixing step (i) and at least one element from the uncoated fibers. As an example, the aluminum-containing matrix may have an Al—Ce composition, the fibers may have a carbon (C) composition, and the intermetallic layer may have, for example, an Al—C, Ce—C, or Al—Ce—C composition. As another example, the aluminum-containing matrix may have an Al—Ce composition, the fibers may have a SiC composition, and the intermetallic layer may have, for example, an Al—C, Ce—C, Al—Ce—C, Al—Si, Ce—Si, Al—Ce—Si, Al—C—Si, Ce—C—Si. or Al—Ce—C—Si composition.

In some embodiments, following the cooling (solidifying step) in either the first or second method, the solidified composite is heated to a temperature sufficient to induce or promote precipitation of at least one element from the aluminum-containing matrix into the intermetallic layer, while the temperature is also maintained below the melting point of the solidified composite. As the heating step is conducted below the melting point of the solidified composite, the solidified composite is maintained as a solid, i.e., it is not melted. The heating step can be referred to as the third step or step (iii). The temperature at which the matrix precipitates at least one element is generally at least 100, 200, 300, 400, 500, or 600° C., or a temperature within a range bounded by any two of the foregoing temperatures, depending on the melting point of the aluminum-containing matrix.

The resulting intermetallic layer has a composition different from the aluminum-containing matrix and the fibers and contains at least one element present in the matrix and at least one element present in the fibers, whether from a coating on the fibers or from the interior (uncoated) parts of the fibers. In some embodiments, the intermetallic layer has a composition that includes at least one alloying element in the matrix and at least one other element present in the fibers. As an example, the aluminum-containing matrix may have an Al—Cu composition, the fibers may have a carbon (C) composition, and Cu may precipitate from the matrix onto the fibers, in which case the intermetallic layer may have, for example, a Cu—C or Al—Cu—C composition. As another example, the aluminum-containing matrix may have an Al—Fe composition, the fibers may have a carbon (C) composition, and Fe may precipitate from the matrix onto the fibers, in which case the intermetallic layer may have, for example, an Fe—C or Al—Fe—C composition. In the foregoing example, if the fiber had a binary composition, such as SiC, the intermetallic may have, for example, an Fe—C, Fe—Si, Fe—Si—C, Al—Fe—C, Al—Fe—Si, or Al—Fe—Si—C composition. As another example, the aluminum-containing matrix may have an Al—Cu—Fe composition, the fibers may have a carbon (C) composition, and at least Cu or Fe may precipitate from the matrix onto the fibers, in which case the intermetallic layer may have, for example, a Cu—C, Fe—C, Cu—Fe—C, Al—Cu, Al—Fe, Al—Cu—C, Al—Fe—C, or Al—Cu—Fe—C composition.

Examples have been set forth below for the purpose of illustration and to describe certain specific embodiments of the invention. However, the scope of this invention is not to be in any way limited by the examples set forth herein.

EXAMPLES

Coating of Carbon Fibers and Integration into an Aluminum Matrix

Aluminum does not directly wet carbon fiber. Therefore, metals were sought which could coat carbon and that could directly wet carbon fiber and form intermetallics at the interface to promote adhesion between the fibers and aluminum-containing matrix. More specifically, elements were considered that are soluble and/or reactive with aluminum and that also will wet carbon. Some possible elements having these characteristics include La, Ce, Cu, Mg, Ti, Fe, and Si. In the experiments described below, copper was a first choice for preliminary investigations due to its already widespread use in the aluminum industry. A206, a high copper-aluminum alloy, was selected for compositing with carbon fiber.

Figure 1B:
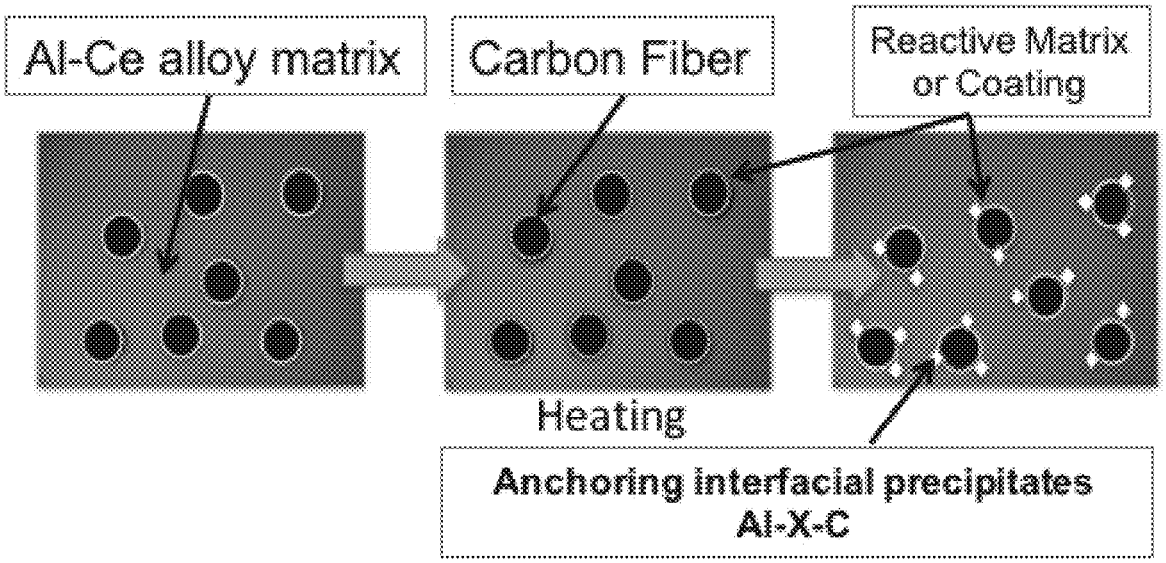

The process used is outlined in FIG. 1. As shown in FIG. 1, the process involves squeeze casting an aluminum alloy (e.g., Al—Cu alloy) into a die where a coated and threaded carbon fiber is present. The high pressure of the squeeze casting process promotes infiltration of the molten aluminum matrix into the gaps between the threaded carbon fibers. The alloy is then heat-treated to precipitate the alloying element (e.g., copper-containing phase) from the aluminum matrix. The copper-containing phase selectively precipitates onto the carbon fibers, thereby forming an intermetallic interface between the fibers and aluminum-containing matrix. Although copper was used in this experiment, numerous other metals having similar characteristics, such as any of the metals described above, could be included in an alloy with aluminum to achieve the same outcome, i.e., to precipitate and form an intermetallic interface. The intermetallic phase creates a strong bond between the fiber and matrix in situ during heat-treatment. In some experiments, a modified A206 aluminum matrix containing Cu, along with Ce, Fe, and B as additional alloying elements, was used as a matrix in which carbon fibers were incorporated. During the heat treatment, Cu and other alloying elements were deposited onto the fibers, which resulted in an Al—Ce—Cu—Fe—C intermetallic interface. Anchoring interfacial precipitates of Al—Cu—C and Al—Fe—C between the carbon fibers and matrix were also observed. FIG. 1B is a general schematic showing the formation of anchoring interfacial precipitates in an Al—Ce—Cu—Fe matrix having carbon fiber incorporated therein.

A challenge when incorporating CF into an aluminum matrix stems from the oxidation reaction that occurs at the Al matrix/CF interface when casting in air, leading to an incoherent interface, and thus, poor load transfer. A novel approach has herein been developed to mitigate this issue through a reactive alloy composition which forms an anchoring carbide phase, in lieu of the oxide, at the matrix/CF interface allowing for a composite with CF to be cast without a cover gas. In the system shown in FIG. 1B, the resulting anchoring carbide phase contains Al and Cu from the matrix and C from the CF.

Elucidation of the Fiber-Matrix Interface

Figures 2A, 2B, 2C, 2D:
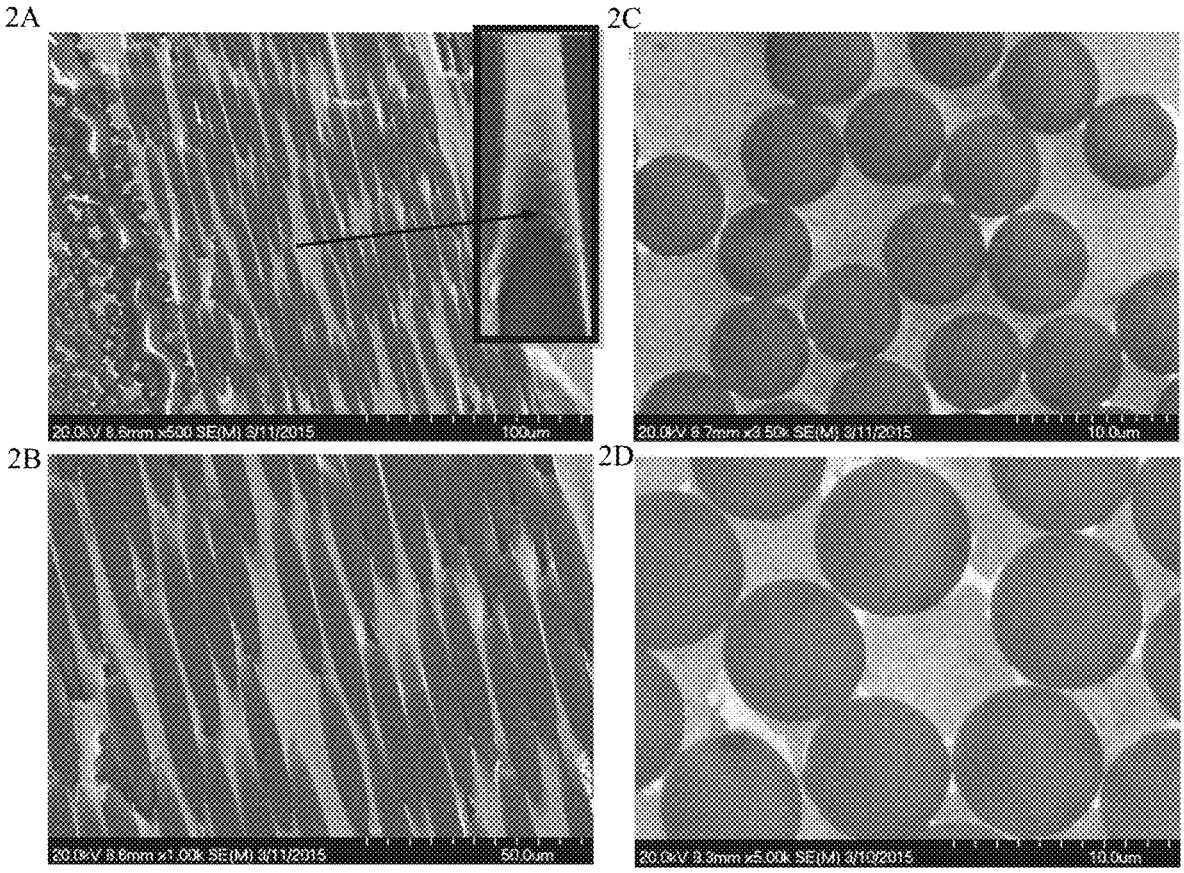
FIGS. 2A-2D.

Following the successful processing of fifty volume percent carbon fiber aluminum composite, scanning electron microscope (SEM) images were taken to determine the effectiveness of the precipitation process described above. FIGS. 2A and 2B show lower and higher magnifications, respectively, of the aluminum carbon fiber composite with fibers aligned in the longitudinal direction. FIGS. 2C and 2D show lower and higher magnifications, respectively, of the aluminum carbon fiber composite with fibers aligned in the transverse direction. Both orientations exhibit good coating of fibers with a precipitate phase. The inset in FIG. 2A shows the presence of intermetallic phases at the fiber matrix interface. As indicated in FIGS. 2A-2D, for fibers aligned in both the longitudinal and transverse direction, a precipitated copper phase has formed at the interface of the fiber and matrix. The evenly distributed fibers show complete penetration of the precipitate phase into the continuous fiber structure. In addition, coalescence between the coatings phases could offer further increases in material strength.

Nano-indentation was used to measure the hardness of the material in the matrix, on the fibers, and at the fiber-matrix interface. Nano-indentation has the distinct capability of measuring very small volumes of material, and can thus provide a good estimation of interface strength by measuring at or near the material interface. Results were measured from an array of 10×10 nano-indentations taken in an area of the sample which contained a portion of matrix, longitudinal, and transverse fibers. By measuring the hardness of the area, it was possible to characterize both interface strengths typical to the sample, i.e., those resulting from longitudinal and transverse fiber alignments. Measurements across the interface show increased modulus and hardness near the interface. For fibers present below the surface, values of hardness and modulus exceeded those measured at matrix specific indentations. In some cases where nano-indentations were taken at a fiber-matrix interface, values were found to be up to three times that of the alloy matrix. These results point to a strong cohesion between the matrix and fiber in both the longitudinal and transverse directions.

Mechanical Properties of the Composite

Figure 3A:
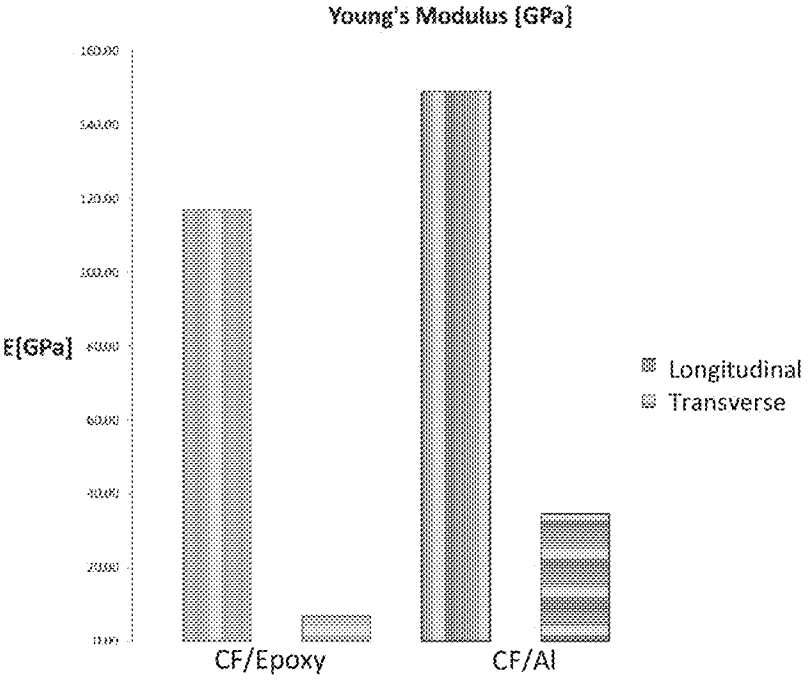
FIGS. 3A, 3B.
Figure 3B:
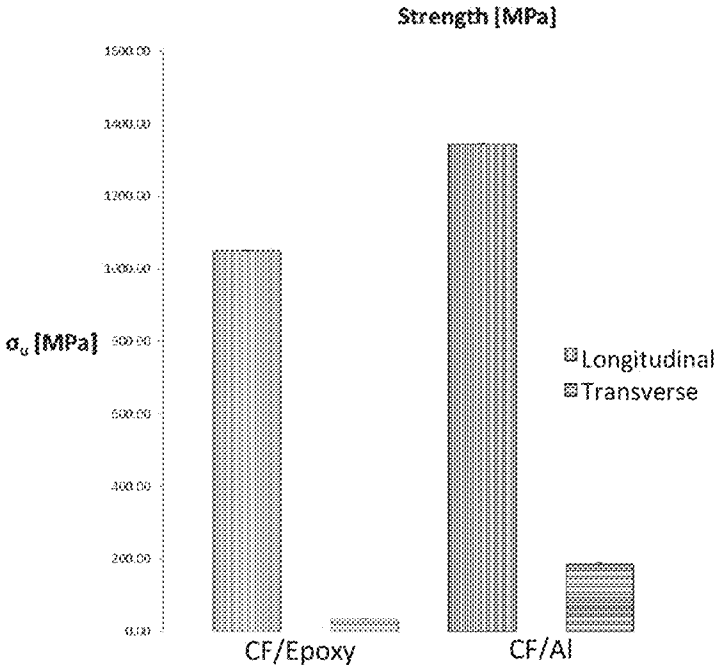

Mechanical properties of the composites described herein can exceed those of a traditional alloy system. FIGS. 3A and 3B show the increases in mechanical strength of the aluminum-carbon fiber composites studied herein over the same properties of epoxy-carbon fiber composites, Specifically, FIG. 3A is a chart comparing the ultimate tensile strength of epoxy composites with the aluminum composite described herein, and FIG. 3B is a chart comparing the Young's modulus of epoxy composites with the aluminum composite described herein. In addition to a general increase in the mechanical properties, the higher degree of anisotropy present in the epoxy composites requires careful fiber alignment during component construction. While similar anisotropy exists in the aluminum composites studied herein, the magnitude is such that additional degrees of design freedom are open to aluminum composites by virtue of the higher transverse rigidity.

Al—Ce and Al—Ce metal matrix composites have the potential to replace ferrous materials in a wide variety of applications. Continuous carbon fiber (CF) is an attractive candidate for reinforcement due to its high tensile strength and low density. Previous attempts at Al alloy/CF composites were unsuccessful due to low penetration of the molten matrix into the porous CF, as well as oxide-contaminated interfaces, which leads to limited adherence of the matrix to the reinforcing fibers. The preliminary results reported herein demonstrate that the new Al-alloy composites with CF, described above, have high specific strength and adequate thermal conductivity when compared with ferrous materials and epoxy composites, both of which lie in the application space where Al-MMCs are of interest. These composites provide a significant benefit at least in view of the higher strength in site specific compositing by strategically placing the reinforcement material where it is needed. This can reduce part sizes and overall CF volume fraction and maximize overall thermal conductivity in Al composite parts.

Thermal Conductivity of the Composite

Figure 4:
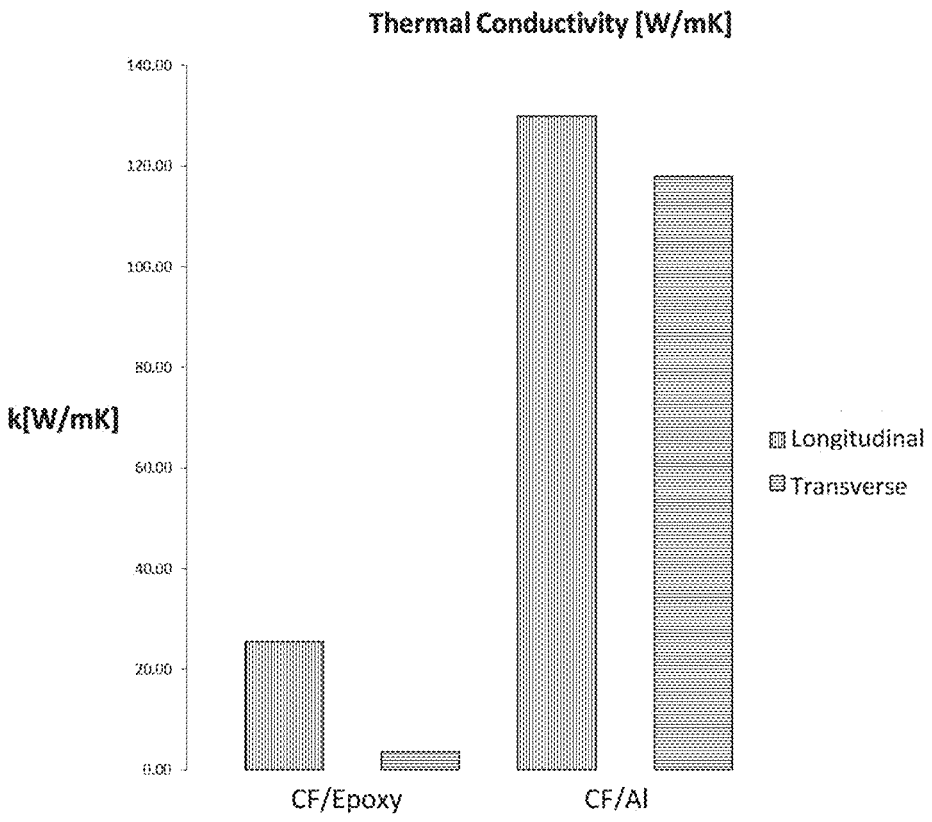
FIG. 4. Graph showing thermal conductivity of epoxy carbon fiber composites compared with thermal conductivity of an aluminum-carbon fiber composite described herein.

FIG. 4 presents the thermal conductivity of epoxy carbon fiber composites compared with thermal conductivity of the aluminum-carbon fiber composite described above. It is very important for a material seeking application in certain industries, such as automotive, to exhibit high thermal conductivity to prevent thermal runaway during operation. Composite epoxy/resin fiber materials do not meet this requirement with thermal conductivity values around 5 W/mK in the transverse direction (FIG. 4). Additionally, the thermal conductivity of epoxy resin composites is governed by the conductivity of the fibers, which is highly anisotropic. When fibers are composited with aluminum alloys, which exhibit much higher thermal conductivity than epoxies (FIG. 4), the alloy thermal conductivity carries greater influence on the thermal conductivity of the bulk, reducing anisotropy. The reduced anisotropy permits less fiber alignment during processing for applications sensitive to thermal conductivity.

Alloy Selection and Casting Processes

Figure 5:
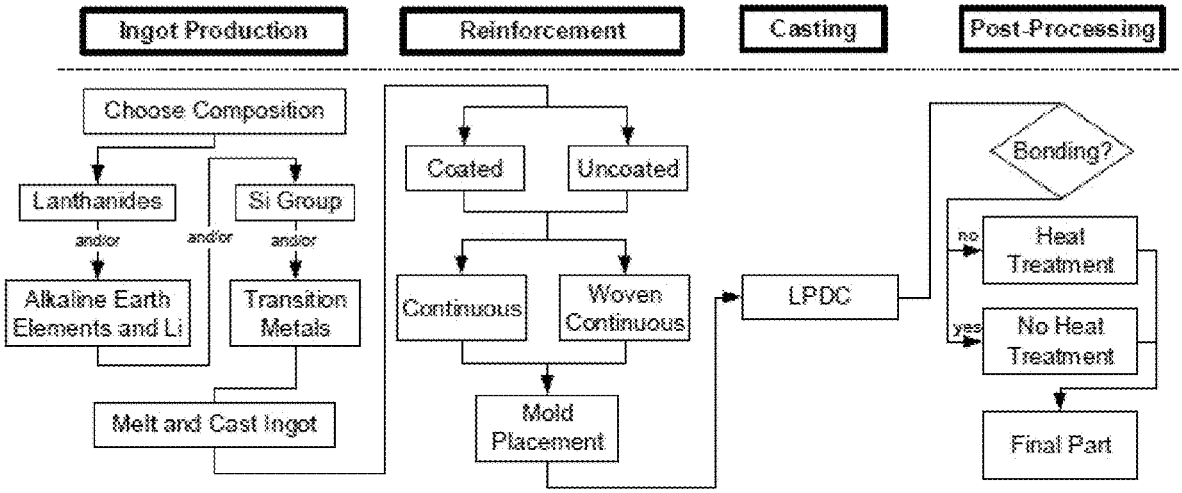
FIG. 5. Flow diagram for an alloy selection and casting process using low pressure die casting (LPDC).

I. FIG. 5 is a flow diagram for an alloy selection and casting process using low pressure die casting (LPDC), During ingot production, the composition of the Al-containing matrix can be alloyed with any combination of lanthanides, alkaline earth elements, and Li, Si group, and transition metals. The elements are combined into an ingot through melting and casting into industry standard ingot trays. The reinforcements, coated or uncoated, are either continuous in a particular direction and placed in the mold, or a continuous woven fiber is placed in the mold. The premade ingots are remelted and LPDC filling of the mold with the reinforcement in place and solidified. The part is removed from the mold. For materials that do not bond upon LPDC, a heat treatment (with resultant precipitation) is conducted to facilitate bonding of the matrix with the fiber according to the process described earlier above.

Figure 6:
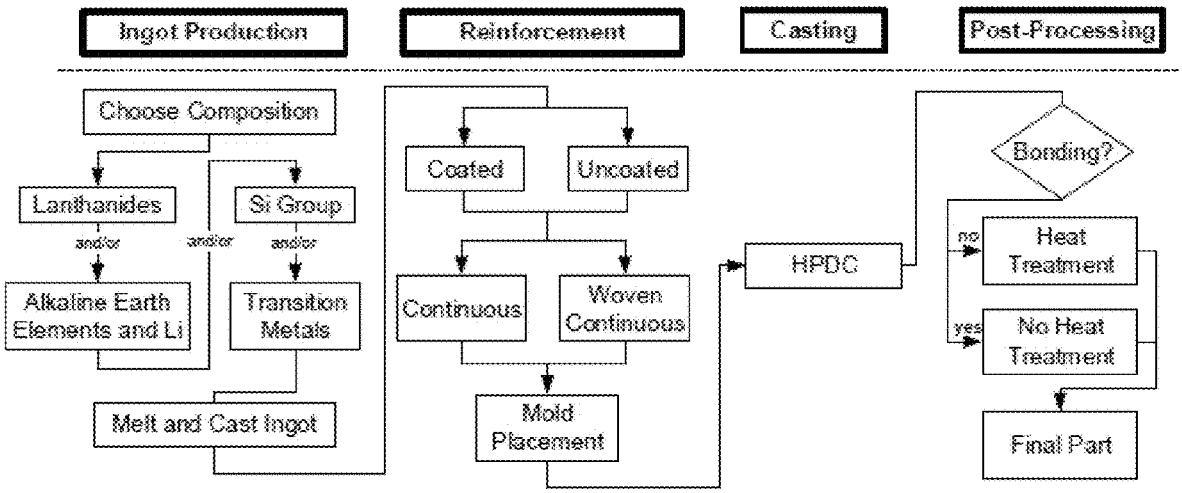
FIG. 6. Flow diagram for an alloy selection and casting process using high pressure die casting (HPDC).

II. FIG. 6 is a flow diagram for an alloy selection and casting process using high pressure die casting (HPDC). The process is as described above for FIG. 5, except that HPDC is used in place of LPDC.

Figure 7:
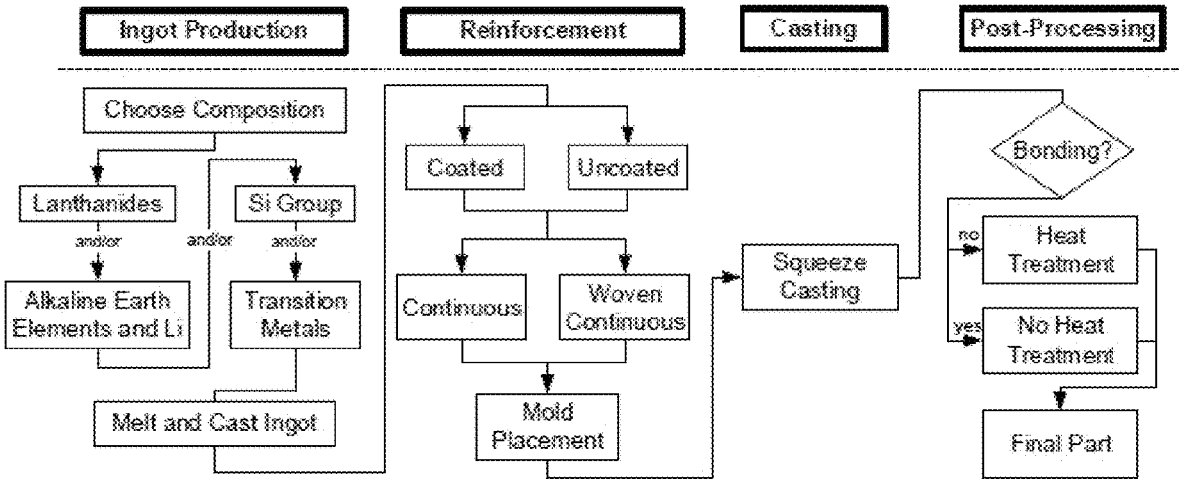
FIG. 7. Flow diagram for an alloy selection and casting process using squeeze casting.

III. FIG. 7 is a flow diagram for an alloy selection and casting process using squeeze casting. The process is as described above for FIG. 5, except that squeeze casting is used in place of LPDC.

Rare Earth Oxide REO Coating Process

Figure 8:
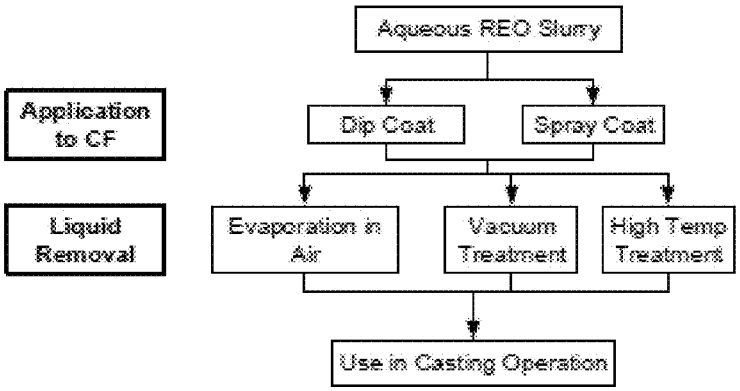
FIG. 8. Flow diagram for a rare earth oxide (REO) coating process in which a fiber (e.g., a carbon fiber, i.e., "CF") is coated with an REO.

FIG. 8 is a flow diagram for an REO coating process. The REO coating process can be used on carbon fiber (CF) or other types of fibers, such as described above. One or more rare earth elements can be coated onto the fibers by this process. The one or more rare earth elements may be selected from, for example, Y, Sc, Ce, La, Pr, Nd, Gd, Tb, Dy, Sm, Eu, Ho, Er, Tm, Yb, and Lu. Once applied, the liquid component of the REO slurry can be removed through either evaporation in air, a vacuum treatment, or a high temperature treatment to facility evaporation. The CF, in this iteration, is then ready for use in the selected casting process.

Figure 9:
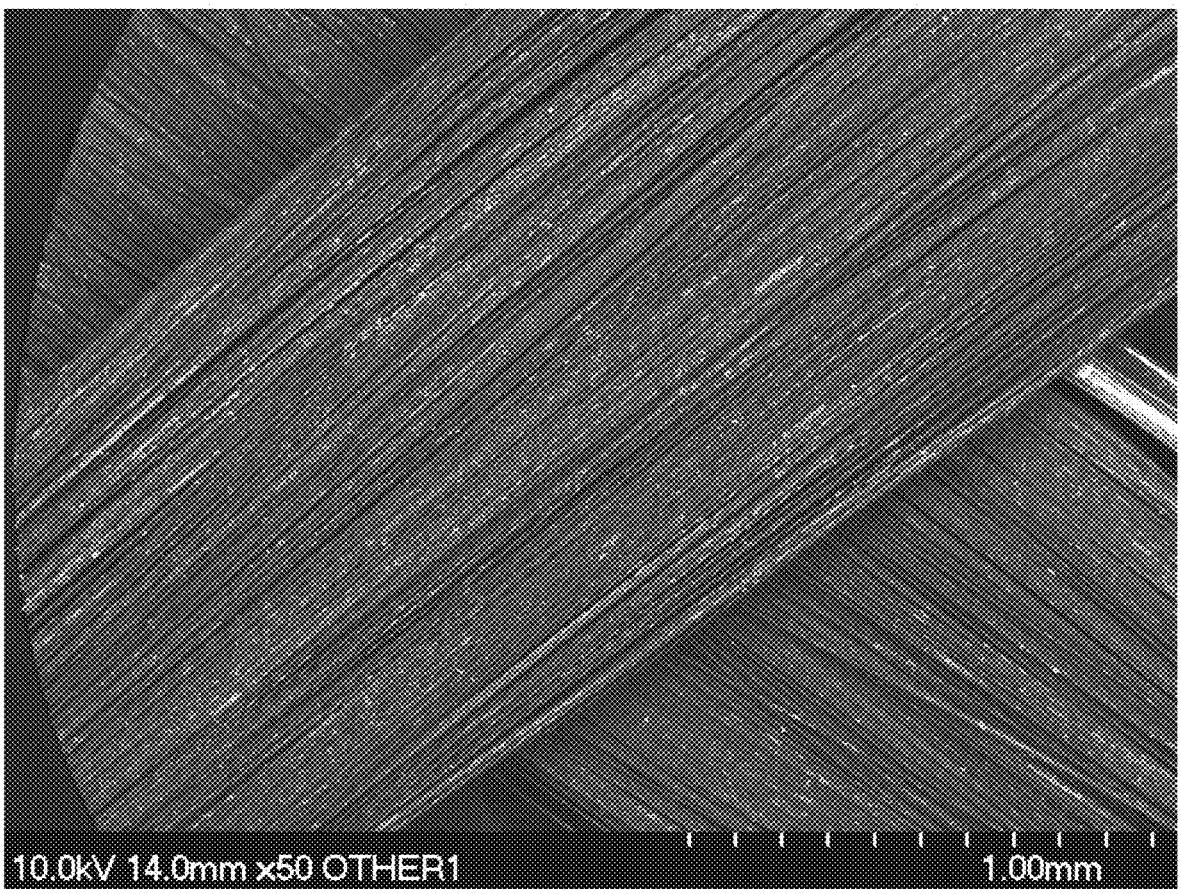
FIG. 9. Low magnification backscattered scanning electron micrograph of CF after undergoing REO coating. The micrographs reveals finely dispersed REO on CF surface.
Figure 10:
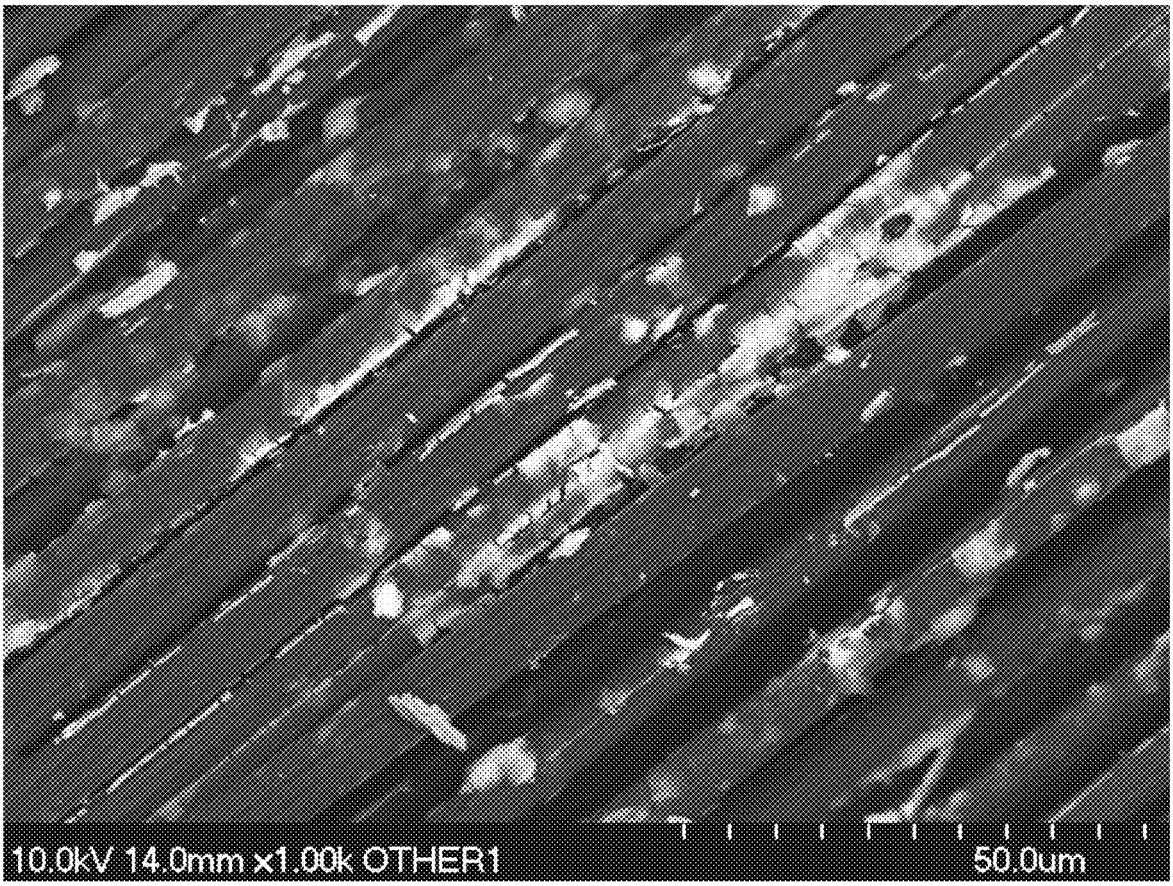
FIG. 10. Higher magnification backscattered scanning electron micrograph of CF after undergoing REO coating showing surface adhesion and infiltration into the CF bundles.

FIG. 9 is a low magnification backscattered scanning electron microscopy (SEM) micrograph of a CF after undergoing REO coating. The SEM micrograph shows the coverage of REO on the surface of the CF; in particular, it reveals a finely dispersed REO on the CF surface. The REO appears as bright white dots on the darker CF in the backscattered image at low magnification. FIG. 10 is a higher magnification backscattered SEM micrograph of a CF after undergoing REO coating. The micrograph shows the surface adhesion and infiltration into the CF bundles. The higher magnification backscattered micrograph in FIG. 10 shows the REO adhering to the surface and infiltrating between fibers. In some instances, the REO begins to react with the surface of the CF prior to the casting process.

While there have been shown and described what are at present considered the preferred embodiments of the invention, those skilled in the art may make various changes and modifications which remain within the scope of the invention defined by the appended claims.

What is claimed is:

1. A solid aluminum-fiber composite comprising:

(i) an aluminum alloy matrix comprising elemental aluminum and a lanthanide, wherein the lanthanide is present in the aluminum alloy matrix in an amount of 2-20 wt %;

(ii) fibers embedded within said aluminum alloy matrix, wherein said fibers have a different composition than said aluminum alloy matrix and impart additional strength to said aluminum alloy matrix as compared to said aluminum alloy matrix in the absence of said fibers embedded therein; and (iii) an intermetallic layer present as an interface between each of said fibers and the aluminum alloy matrix, wherein said intermetallic layer comprises intermetallic compounds containing aluminum and said lanthanide and has a composition different from said aluminum alloy matrix and said fibers, and wherein the intermetallic layer includes anchoring interfacial precipitates; wherein said aluminum-fiber composite is produced by a process in which the aluminum alloy matrix and fibers are combined and subjected to a pressure of at least 50 bar.

2. The solid aluminum-fiber composite of claim 1, wherein said aluminum alloy matrix contains aluminum further alloyed with at least one element selected from the group consisting of copper, iron, titanium, vanadium, chromium, manganese, cobalt, nickel, zinc, scandium, yttrium, thorium, magnesium, calcium, silicon, zirconium, lithium, and boron.

3. The solid aluminum-fiber composite of claim 1, wherein said fibers have a composition containing at least one element selected from the group consisting of transition metals, lanthanide elements, and main group elements.

4. The solid aluminum-fiber composite of claim 3, wherein said fibers have a composition containing at least one element selected from the group consisting of carbon, silicon, iron, copper, lanthanum, cerium, and magnesium.

5. The solid aluminum-fiber composite of claim 1, wherein said fibers are carbon-containing fibers, and said carbon is elemental carbon.

6. The solid aluminum-fiber composite of claim 5, wherein said carbon-containing fibers are within a carbon fiber tow.

7. The solid aluminum-fiber composite of claim 5, wherein said carbon-containing fibers are within a woven carbon structure.

8. The solid aluminum-fiber composite of claim 1, wherein said intermetallic layer contains at least one element that is not present in the aluminum alloy matrix.

9. The solid aluminum-fiber composite of claim 8, wherein said element that is not present in the aluminum alloy matrix is selected from transition metal elements.

10. The solid aluminum-fiber composite of claim 1, wherein said intermetallic layer contains at least one element that is also present in the fibers and another element that is not present in the aluminum alloy matrix or in the fibers.

11. The solid aluminum-fiber composite of claim 10, wherein said another element that is not present in the aluminum alloy matrix or in the fibers is selected from transition metal elements.

12. The solid aluminum-fiber composite of claim 1, wherein said intermetallic layer contains at least one element that is present in said fibers.

13. The solid aluminum-fiber composite of claim 1, wherein said lanthanide is present in the aluminum alloy matrix in an amount of 5-20 wt %.

14. A solid aluminum-fiber composite comprising:

(i) an aluminum alloy matrix comprising elemental aluminum and copper, wherein the copper is present in the aluminum alloy matrix in an amount of 2-10 wt %;

(ii) fibers embedded within said aluminum alloy matrix, wherein said fibers have a different composition than said aluminum alloy matrix and impart additional strength to said aluminum alloy matrix as compared to said aluminum alloy matrix in the absence of said fibers embedded therein; and (iii) an intermetallic layer present as an interface between each of said fibers and the aluminum alloy matrix, wherein said intermetallic layer comprises intermetallic compounds containing aluminum, copper, and a lanthanide element and has a composition different from said aluminum alloy matrix and said fibers and wherein the intermetallic layer includes anchoring interfacial precipitates; wherein said aluminum fiber composite is produced by a process in which the aluminum alloy matrix and fibers are combined and subjected to a pressure of at least 50 bar.

15. A method for producing the solid aluminum-fiber composite of claim 1, the method comprising:

(i) combining and subjecting, under a pressure of at least 50 bar, coated fibers with the aluminum alloy matrix in molten form to produce a mixture of said molten aluminum alloy matrix and coated fibers, wherein each of said coated fibers comprises a fiber and a coating on surfaces of said fibers, wherein said coated fibers have a different composition than said aluminum alloy matrix, wherein said coating has a composition different from said aluminum alloy matrix and the uncoated portion of said coated fibers and contains at least one element other than aluminum and which alloys with at least aluminum; and (ii) cooling said mixture to produce said solid aluminum-fiber composite.

16. The method of claim 15, further comprising, after said cooling step (ii), heating said solid aluminum-fiber composite to a temperature below the melting point of the solid aluminum-fiber composite to induce or promote precipitation of at least one element from the aluminum alloy matrix into the intermetallic layer.

17. The method of claim 15, wherein said aluminum alloy matrix further contains at least one alloying element selected from the group consisting of copper, iron, titanium, vanadium, chromium, manganese, cobalt, nickel, zinc, scandium, yttrium, thorium, magnesium, calcium, silicon, zirconium, lithium, and boron.

18. The method of claim 15, wherein said fibers have a composition containing at least one element selected from the group consisting of transition metals, lanthanide elements, and main group elements.

19. The method of claim 15, wherein said fibers are carbon-containing fibers, and said carbon is elemental carbon.

20. The method of claim 15, wherein, in step (i), said fibers are within a bundle or interconnected assembly of fibers with spacings between said fibers, and the combining and subjecting step is performed by pressing said aluminum alloy matrix into said spacings.

21. A method for producing the solid aluminum-fiber composite of claim 1, the method comprising:

(i) combining and subjecting, under a pressure of at least 50 bar, uncoated fibers with the aluminum alloy matrix to produce a mixture of molten aluminum alloy matrix and uncoated fibers, (ii) cooling said mixture to produce said solid aluminum-fiber composite.

22. The method of claim 21, further comprising, after said cooling step (ii), heating said solid aluminum-fiber composite to a temperature below the melting point of the solid aluminum-fiber composite to induce or promote precipitation of at least one element from the aluminum alloy matrix into the intermetallic layer.

23. The method of claim 21, wherein said aluminum alloy matrix further contains at least one alloying element selected from the group consisting of copper, iron, titanium, vanadium, chromium, manganese, cobalt, nickel, zinc, scandium, yttrium, thorium, magnesium, calcium, silicon, zirconium, lithium, and boron.

24. The method of claim 21, wherein said uncoated fibers have a composition containing at least one element selected from the group consisting of transition metals, lanthanide elements, and main group elements.

25. The method of claim 21, wherein said uncoated fibers are carbon-containing fibers, and said carbon is elemental carbon.

26. The method of claim 21, wherein, in step (i), said uncoated fibers are within a bundle or interconnected assembly of uncoated fibers with spacings between said uncoated fibers, and the combining and subjecting step is performed by pressing said aluminum alloy matrix into said spacings.

* * * * *